US006682069B2

(12) United States Patent
Shibabuki

(10) Patent No.: US 6,682,069 B2
(45) Date of Patent: Jan. 27, 2004

(54) SHEET CONVEYOR SYSTEM

(75) Inventor: Tadanobu Shibabuki, Kaisei-machi (JP)

(73) Assignee: Fuji Photo Film Co., Ltd., Kanagawa-ken (JP)

( * ) Notice: Subject to any disclaimer, the term of this patent is extended or adjusted under 35 U.S.C. 154(b) by 159 days.

(21) Appl. No.: 09/987,852

(22) Filed: Nov. 16, 2001

(65) Prior Publication Data

US 2002/0060423 A1 May 23, 2002

(30) Foreign Application Priority Data

Nov. 17, 2000 (JP) ..... 2000-350835

(51) Int. Cl.[7] ..... B65H 5/06

(52) U.S. Cl. ..... 271/274; 271/272; 271/10.12; 271/243; 271/245; 399/395

(58) Field of Search ..... 271/272, 274, 271/10.12, 226, 243, 245, 273; 399/395

(56) References Cited

U.S. PATENT DOCUMENTS 4,195,832 A * 4/1980 Krumrey ..... 271/274
4,420,151 A * 12/1983 Kobayashi ..... 271/263
5,000,439 A * 3/1991 Yoshizawa ..... 271/274
5,540,423 A * 7/1996 Nakano ..... 271/10.12
5,921,545 A * 7/1999 Kobayashi et al. ..... 271/242
5,992,846 A * 11/1999 Umeda ..... 271/248
6,032,951 A * 3/2000 Yamaguchi ..... 271/274
6,494,451 B2 * 12/2002 Michel ..... 271/274

FOREIGN PATENT DOCUMENTS

JP 57125934 A * 8/1982 ..... G03B/41/16
JP 63158275 A * 7/1988 ..... B41J/13/02
JP 07025508 A * 1/1995 ..... B65H/5/06
JP 08259029 A * 10/1996 ..... B65H/5/06
JP 11011738 A * 1/1999 ..... B65H/5/06
JP 2002087633 A * 3/2002 ..... B65H/5/06

* cited by examiner

*Primary Examiner*—Patrick Mackey
(74) *Attorney, Agent, or Firm*—Sughrue Mion, PLLC

(57) ABSTRACT

A conveyor system conveys sheets of different widths in a direction normal to the direction of width with an edge of each sheet held along a reference position. The conveyor system includes a drive roller and a nip roller and conveys the sheet with the nip roller urged toward the drive roller under its gravity and a predetermined urging force. The nip roller is heavier at a part on the side of the reference position than at a part on the side opposite to the reference position and is substantially uniform in weight over a predetermined length between the end on the side of the reference position and a part at a predetermined distance from the end on the side of the reference position, and the predetermined urging force is set stronger on the side opposite to the reference position than on the side of the reference position.

5 Claims, 12 Drawing Sheets

SHEET CONVEYOR SYSTEM

BACKGROUND OF THE INVENTION

1. Field of the Invention

This invention relates to a sheet conveyor system which conveys a plurality of kinds of sheet material different in width, and more particularly to such a sheet conveyor system which can convey straight the sheet to be conveyed irrespective of width.

2. Description of the Related Art

Recently, there has been put into practice a system in which a radiation image of an object such as a human body is once stored on a stimulable phosphor sheet (or a radiation image conversion panel) by exposing the stimulable phosphor sheet to radiation through the object to have the stimulable phosphor sheet store radiation energy, and stimulated emission which is emitted from each part of the stimulable phosphor sheet upon exposure to stimulating light in proportion to the radiation energy stored thereon is photoelectrically read, thereby obtaining a digital image signal representing the radiation image stored on the stimulable phosphor sheet, and the digital image signal is reproduced as a visible image on a recording medium such as a photographic film or on an image display system such as those using a CRT.

In such a system, the stimulable phosphor sheets are handled with each contained in one cassette or with the sheets contained in one magazine by two or more.

In the system, there is generally employed a radiation image information read-out apparatus provided with a read-out section for reading out a radiation image stored in stimulable phosphor sheets and an erasing section for exposing the stimulable phosphor sheet to erasing light after the image signal is obtained from the stimulable phosphor sheet so that the residual energy of the radiation is fully released from the stimulable phosphor sheet. In the radiation image information read-out apparatus, stimulable phosphor sheets on which radiation images of objects have been recorded by external radiation image recording apparatus are loaded with each stimulable phosphor sheet contained in a cassette or with the sheets contained in magazines by two or more. (The cassettes and the magazines will be referred to as a "container", hereinbelow.) Then the lid of the container is opened and a sheet conveyor system takes out the stimulable phosphor sheets from the container one by one and conveys the stimulable phosphor sheet to the read-out section.

The read-out section reads a radiation image recorded on the stimulable phosphor sheet. After read-out, the stimulable phosphor sheet is transferred to the erasing section and the residual energy of the radiation is fully released from the stimulable phosphor sheet. Thereafter, the renewed stimulable phosphor sheet is returned to the original container or put in another container and removed from the radiation image information read-out apparatus together with the container.

Further, the aforesaid system is provided with an image reproducing system for reproducing a radiation image on a photosensitive material such as a photographic film. In the image reproducing system, a plurality of sheets of photosensitive material are taken out from a magazine one sheet by one sheet by a suction mechanism and transferred to a sheet conveyor system, which conveys the photosensitive material sheet to a recording system. The recording system records a radiation image on the photosensitive material sheet, for instance, by exposing the sheet to a laser beam on the basis of an image signal obtained from the stimulable phosphor sheet.

The stimulable phosphor sheet and the photographic film (such sheets will be simply referred to as a "sheet", hereinbelow) are in various sizes by purpose. Accordingly, the sheet conveyor system generally conveys the sheet with one side edge of the sheet kept in a reference position.

FIG. 10 shows an example of the conventional sheet conveyor system. As shown in FIG. 10, the conventional sheet conveyor system has a roller pair 103, one of which is a drive roller 101 which is driven by, for instance, an electric motor (not shown) and the other of which is a nip roller 102 which is positioned above the drive roller 101 and is associated with the drive roller 101 to nip therebetween a sheet 140 to be conveyed. The drive roller 101 comprises a shaft 111 and three roller portions 112A, 112B and 112C which are of rubber and mounted on the shaft 111 at predetermined intervals. Similarly the nip roller 102 comprises a shaft 121 and three roller portions 122A, 122B and 122C which are of rubber and mounted on the shaft 121 at predetermined intervals. The nip roller 102 is pressed against the drive roller 101 by compression springs 127*a* and 127*b* by way of bearings 125*a* and 125*b* disposed on opposite ends thereof. When the drive roller 101 is driven, the sheet 140 is conveyed nipped between the drive roller 101 and the nip roller 102 with one side edge 140*a* of the sheet 140 held in a reference position 105 irrespective of the width of the sheet 140. That is, when the width of the sheet 140 is small, the sheet 140 is conveyed nipped between the roller portions 112A and 122A and 112B and 122B at its opposite edge portions. When the width of the sheet 140 is large, the sheet 140 is conveyed nipped between the roller portions 112A and 122A, 112B and 122B and 112C and 122C at its opposite edge portions and an intermediate portion.

Setting of force of the springs 127*a* and 127*b* will be described, hereinbelow. When a large size sheet 140 is to be conveyed as shown in FIG. 11, the conveying force is maximized at the outer side of the roller portions 112A and 122A and at the outer side of the roller portions 112C and 122C. Accordingly when the nipping force f1 acting at the outer side of the roller portions 112A and 122A is equal to the nipping force f2 acting at the outer side of the roller portions 112C and 122C, the sheet 140 can be conveyed straight. The nipping force f1 acting at the outer side of the roller portions 112A and 122A can be made equal to the nipping force f2 acting at the outer side of the roller portions 112C and 122C, when the force F1 of the compression spring 127*a* is set equal to the force F2 of the compression spring 127*b*.

To the contrast, when a small size sheet 140 is to be conveyed, the sheet 140 is nipped only between the roller portions 112A and 122A and between the roller portions 112B and 122B and as a result the roller portions 112C and 122C are spaced from each other as shown in FIG. 10. When a space is formed between the roller portions 112C and 122C while the opposite ends of the nip roller are pressed against the drive roller 101 by the forces F1 and F2 of the compression springs 127*a* and 127*b*, a moment which tends to nullify the space acts on the nip roller 102 together with the gravity of the roller portion 122C, which makes the nip roller 102 inclined in a direction in which the space is nullified. When the nip roller 102 is thus inclined, the nipping force acting between the roller portions 112B and 122B becomes stronger than that acting between the roller portions 112A and 122A and the portion of the sheet 140 between the roller portions 112B and 122B comes to be conveyed at a higher speed than the portion of the sheet 140 between the roller portions 112A and 122A, whereby the sheet 140 comes to be conveyed obliquely rightward as seen in FIG. 10. Further, since the roller portions 112B and 122B are of rubber, the roller portions 112B and 122B are apt to collapse and accordingly, it is difficult to prevent production of a difference in conveying speed. In view of conveying straight small size sheets, the forces of the springs 127*a* and 127*b* should be set in the following manner.

When a small size sheet 140 is to be conveyed as shown in FIG. 12, the conveying force is maximized at the outer side of the roller portions 112A and 122A and at the outer side of the roller portions 112B and 122B. Accordingly when the nipping force f3 acting at the outer side of the roller portions 112A and 122A is equal to the nipping force f4 acting at the outer side of the roller portions 112B and 122B, the sheet 140 can be conveyed straight. The nipping force f3 acting at the outer side of the roller portions 112A and 122A can be made equal to the nipping force f4 acting at the outer side of the roller portions 112B and 122B, when $F3 \cdot L = F4 \cdot L/(L-L2)$+gravity of the roller portion 122C, wherein L represents the distance between the fulcrums of opposite ends of the nip roller 102 (i.e., the distance between the bearings 125*a* and 125*b*, L2 represents the distance between the bearing 125*b* and the outer side of the roller portions 112B and 122B, and F3 and F4 respectively represent the forces of the compression springs 127*a* and 127*b*. That is, F3>F4.

This means that the small size sheet 140 can be conveyed straight when the force F3 of the compression spring 127*a* on the side of the reference position 105 is stronger than the force F4 of the compression spring 127*b* so that the nipping force acting on the sheet 140 between the roller portions 112A and 122A becomes substantially equal to that acting on the sheet 140 between the roller portions 112B and 122B.

Whereas when the urging force of the compression spring 127*a* on the side of the reference position 105 is stronger than that of the compression spring 127*b* (F1>F2, F3>F4), the nipping force acting between the roller portions 112A and 122A becomes stronger than that acting between the roller portions 112C and 122C when the large size sheet 140 is conveyed and the portion of the sheet 140 between the roller portions 112A and 122A comes to be conveyed at a higher speed than the portion of the sheet 140 between the roller portions 112C and 122C, whereby the sheet 140 comes to be conveyed obliquely leftward, though the degree of inclination is suppressed by the friction force between the sheet 140 and the roller portions 112A, 112B, 112C, 122A 122B and 122C.

However, when the stimulable phosphor sheet is conveyed obliquely in the radiation image information read-out apparatus, the edges of the image obtained are inclined and the image becomes unsightly even if the inclination of the stimulable phosphor sheet is slight. Though inclination of the edges of the image can be nullified by image processing, it becomes impossible to nullify the inclination of the edges of the image when the degree of inclination exceeds a certain value. That is, it is required to convey the sheet as straight as possible.

SUMMARY OF THE INVENTION

In view of the foregoing observations and description, the primary object of the present invention is to provide a sheet conveyor system which can convey straight a sheet of any size.

In accordance with the present invention, there is provided a sheet conveyor system which conveys a plurality of kinds of sheet material, different at least in dimension in a first direction, in a second direction normal to the first direction with an edge of each sheet material extending in the second direction held along a reference position, the sheet conveyor system comprising a roller pair which consists of a drive roller and a nip roller and conveys the sheet material in the second direction by driving the drive roller with the nip roller urged toward the drive roller under its gravity and a predetermined urging force to press the sheet material against the drive roller, wherein the improvement comprises that the nip roller is larger in weight of a part on the side of the reference position than that of a part on the side opposite to the reference position and is substantially uniform in weight over a predetermined length between the end on the side of the reference position and a part at a predetermined distance from the end on the side of the reference position, and said predetermined urging force is set stronger on the side opposite to the reference position than on the side of the reference position.

The predetermined length is set according to the dimension in the first direction of the sheet material which is the smallest in the dimension in the first direction in the sheet materials to be conveyed. For example, the predetermined length is set to a half of the dimension in the first direction of the sheet material which is the smallest in the dimension in the first direction in the sheet materials to be conveyed.

When the weight of the nip roller on the side of the reference position is larger than the weight of the part on the side opposite to the reference position and a sheet material whose width is substantially equal to the length of the nip roller is conveyed, the sheet nipping force becomes stronger on the reference position side and the sheet material is inclined away from the reference position. The inclination of the sheet material can be cancelled by setting said predetermined urging force stronger on the side opposite to the reference position than on the side of the reference position.

For example, each of the drive roller and the nip roller may comprise a shaft extending in the first direction (the direction of width of the sheet material) and a plurality of roller portions provided on the shaft at predetermined intervals in the longitudinal direction thereof, with the part between the roller portion nearest to the reference position and the roller portion adjacent to the roller portion nearest to the reference position being uniform in weight.

The predetermined interval is an interval such that the roller portions can nip the sheet material at its side edges or portions near to the side edges irrespective of the size of the sheet material. For example, when the sizes of the sheet materials to be conveyed are only a large size which is substantially equal to the length of the nip roller in dimension in the first direction and a small size which is substantially equal to a half of the length of the nip roller in dimension in the first direction, the predetermined interval is such that three roller portions are disposed respectively on opposite ends of the nip roller and the center of the same.

It is preferred that the roller portion be formed of a high friction material such as rubber. Further when the roller portion is 1.5 to 2 mm in thickness, collapse by the urging force of the nip roller can be suppressed.

The shaft of the nip roller may be larger in outer diameter at the reference position side portion than that at the portion remote from the reference position.

The shaft of the nip roller may comprise, for instance, a hollow pipe-like member and a core shaft which supports the pipe-like member for rotation with the core shaft being larger in outer diameter at the reference position side portion than that at the portion remote from the reference position.

Further, the reference position side portion of the nip roller may be formed of a material which is heavier than that forming the portion remote from the reference position.

In the sheet conveyor system in accordance with the present invention, the nip roller is urged toward the drive roller under its gravity and a predetermined urging force when conveying a sheet material. Since the nip roller is larger in weight of a part on the side of the reference position than that of a part on the side opposite to the reference position and is substantially uniform in weight over a predetermined length between the end on the side of the reference position and a part at a predetermined distance from the end on the side of the reference position, sheet materials which are small in width than the predetermined length can be conveyed substantially straight since the pressing force acting on the sheet material during conveyance is substantially uniform in the direction of width even if the urging force is stronger on the side opposite to the reference position than on the side of the reference position.

When the sheet material to be conveyed is substantially equal in width to the length of the nip roller, the sheet material can be conveyed substantially straight since the pressing force acting on the sheet material during conveyance is substantially equal at opposite edges of the sheet material since the urging force is stronger on the side opposite to the reference position than on the side of the reference position though the pressing force acting on the sheet material under the gravity of the nip roller is stronger on the reference position side than the side opposite to the reference position.

DESCRIPTION OF THE PREFERRED EMBODIMENTS

Figure 1:
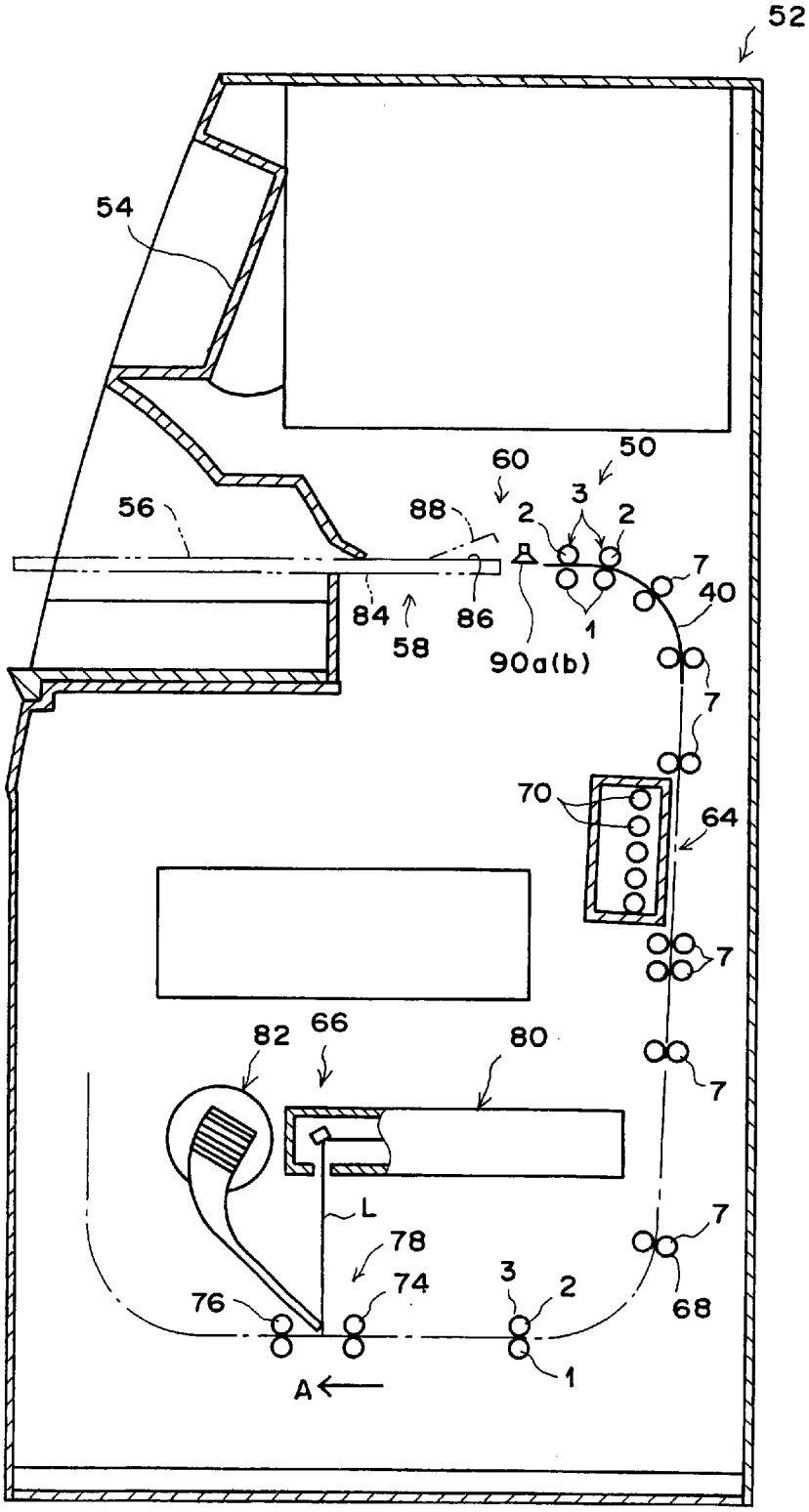
FIG. 1 is a schematic view showing a radiation image information read-out apparatus provided with a sheet conveyor system in accordance with an embodiment of the present invention.

In FIG. 1, a touch panel 54 which functions as a control panel and a monitor is provided on an upper front portion of a radiation image information read-out apparatus 52, and a cassette loading section 58 in which a cassette 56 is removably loaded is provided below the touch panel 54. A sheet separator 60 is formed in the cassette loading section 58, and an erasing section 64 and a read-out section 66 are connected downstream of the sheet separator 60 by way of a sheet conveyor system 50. The erasing section 64 comprises a plurality of erasing light sources 70 arranged along the sheet conveyor system 50.

The read-out section 66 comprises a sub-scanning system 78 which conveys a stimulable phosphor sheet 40 taken out from the cassette 56 in a sub-scanning direction (the direction of arrow A) by two roller pairs 74 and 76, an optical system 80 which causes a laser beam L to scan the stimulable phosphor sheet 40 in a main scanning direction substantially normal to the sub-scanning direction while it is being conveyed in the sub-scanning direction, and a light condensing system 82 which photoelectrically reads the stimulated emission emitted from the stimulable phosphor sheet 40 upon exposure to the laser beam L.

The cassette 56 comprises a cassette body 84 and a lid 88 which closes and opens the opening 86 of the cassette body 84. The cassette loading section 58 is provided with a lid opening means (not shown) for opening and closing the lid 88.

The sheet separator 60 comprises a pair of suction pads 90*a* and 90*b* which are movable into the cassette body 84 with the lid 88 opened, and a transfer mechanism (not shown) which moves back and forth the suction pads 90*a* and 90*b* between the cassette 56 and the sheet conveyor system 50 to transfer the stimulable phosphor sheet between the cassette 56 and the sheet conveyor system 50.

The sheet conveyor system 50 comprises two drive roller pairs 3 disposed downstream of the sheet separator 60, each comprising a drive roller 1 rotated by a drive means such as an electric motor (not shown) and a nip roller 2 which nips the stimulable phosphor sheet 40 together with the drive roller 1, a plurality of roller pairs 7, and another drive roller pair 3 disposed upstream of the read-out section 66 and downstream of the roller pairs 7.

The two drive roller pairs 3 disposed downstream of the sheet separator 60 will be described with reference to FIGS. 2 and 3, hereinbelow. The drive roller pair 3 disposed upstream of the read-out section 66 and downstream of the roller pairs 7 is the same as one of the drive roller pairs 3 disposed downstream of the sheet separator 60, and accordingly only the latter will be described here.

Figure 2:
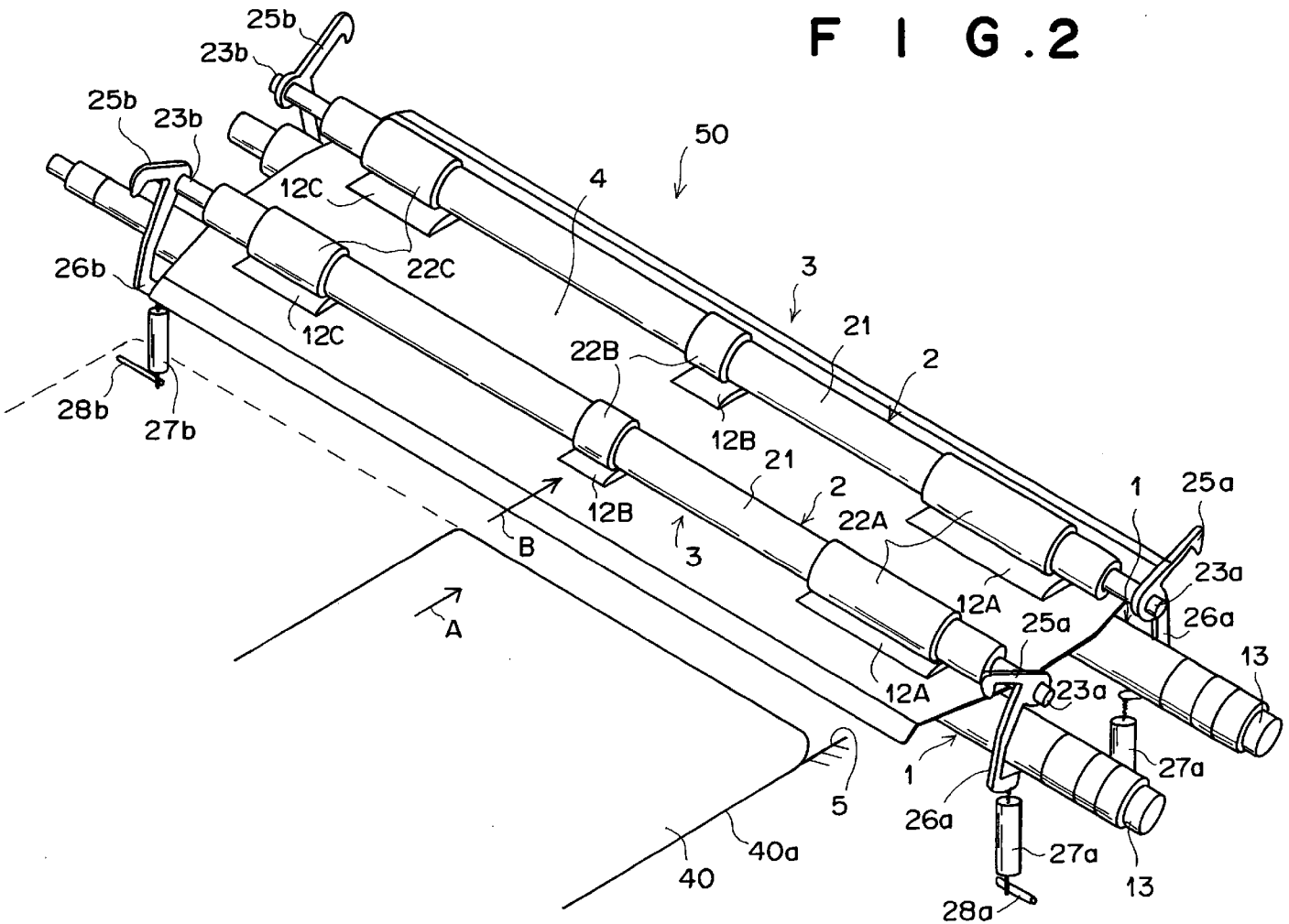
FIG. 2 is a perspective view showing the two roller pairs employed in the sheet conveyor system.
Figure 3:
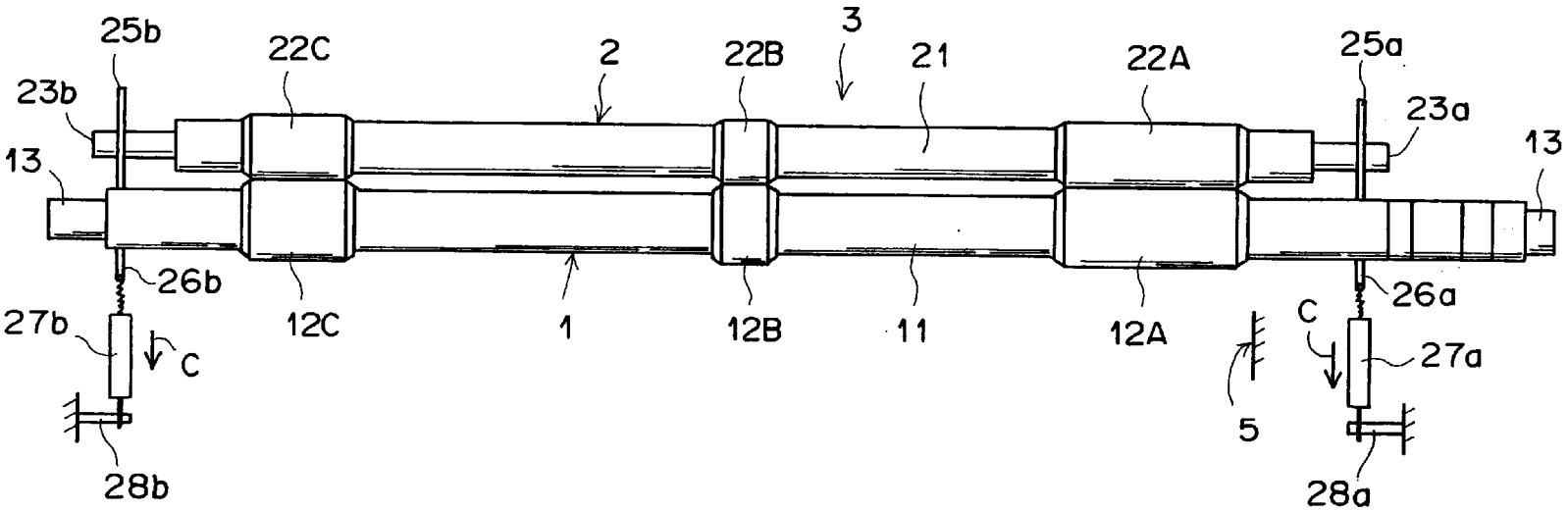
FIG. 3 is a view taken in the direction of arrow B in FIG. 2.

As shown in FIG. 2, the two roller pairs 3 are arranged in the direction of conveyance (the sub-scanning direction). A guide plate 4 is provided between the roller pairs 3 to guide the stimulable phosphor sheet 40 from upstream to downstream. The guide plate 4 is abbreviated in FIG. 3. In this particular embodiment, it is assumed that the sheet conveyor system 50 conveys two kinds of stimulable phosphor sheet 40, which are different in dimension of the main scanning direction. Further, the stimulable phosphor sheet 40 is conveyed so that its one side edge 40*a* is moved along a reference position 5.

The drive roller 1 comprises a shaft 11 which is like a hollow pipe of resin, and three roller portions 12A, 12B and 12C of rubber which are respectively mounted on the shaft 11 is at one end, the center and the other end thereof.

The space between the roller portions 12A and 12B is such that the roller portions 12A and 12B can nip the small size stimulable phosphor sheet 40 at its side edges, and the space between the roller portions 12A and 12C is such that the roller portions 12A and 12C can nip the large size stimulable phosphor sheet 40 at its side edges. A core shaft 13 of stainless steel extends through the shaft 11 and opposite end portions of the core shaft 13 are supported for rotation by support members (not shown). One end portion of the core shaft 13 is driven by a drive source (not shown) to rotate the shaft 11.

The nip roller 2 comprises a shaft 21 which is like a hollow pipe of resin, and three roller portions 22A, 22B and 22C of rubber which are respectively mounted on the shaft 21 to be opposed to the roller portions 12A, 12B and 12C of the drive roller 1.

Each of the roller portions 12A, 12B, 12C, 22A, 22B and 22C is about 1.5 to 2 mm in thickness.

Figure 4:
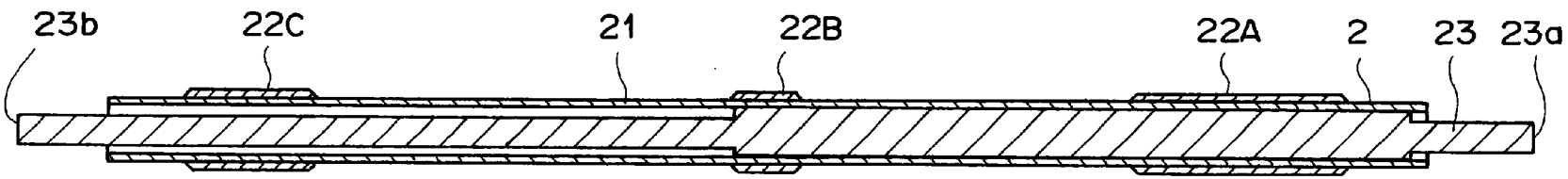
FIG. 4 is a cross-sectional view of the nip roller taken along the rotational axis thereof.
Figure 5:
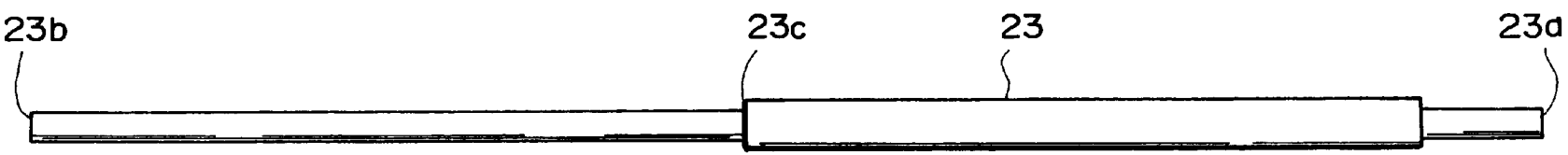
FIG. 5 is a view showing the core shaft.

As shown in FIG. 4, the nip roller 2 has a core shaft 23 of stainless steel which extends through the shaft 21. As shown in FIG. 5, the portion of the core shaft 23 between the end 23*a* near to the reference position 5 and a portion 23*c* substantially at the center thereof is thicker than the portion of the core shaft 23 between the end 23*b* remote from the reference position 5*a* and the central portion 23*c*. For example, the outer diameter of the former portion is 13 mm and that of the latter portion is 8 mm. Instead the core shaft 23 may be uniform in thickness over the entire length thereof and a weight such as of lead may be mounted on the end 23*a* and the central portion 23*c* so that the core shaft 23 is uniform in weight between the end 23*a* and the central portion 23*c*.

The opposite end portions 23*a* and 23*b* of the core shaft 23 are supported for rotation by bearings 25*a* and 25*b*. The bearings 25*a* and 25*b* are respectively provided with curved portions 26*a* and 26*b* which are curved to clear the drive roller 1. The lower ends of the curved portions 26*a* and 26*b* are connected to one ends of compression springs 27*a* and 27*b* which are urged in the direction of arrow C in FIG. 3. The other ends of the compression springs 27*a* and 27*b* are connected to support portions 28*a* and 28*b*. That is, the nip roller 2 is pressed against the drive roller 1 under its gravity and the force of the compression springs 27*a* and 27*b*. Further, in order to compensate for difference in weight between opposite end portions due to difference in the outer diameter, the compression spring 27*b* is made stronger than the compression spring 27*a*.

Operation of this embodiment will be described hereinbelow. A cassette 56 containing therein, in light-shielding fashion, a stimulable phosphor sheet 40 bearing thereon a radiation image of an object such as a human body is set to the cassette loading section 58. Upon setting the cassette 56, a lock release means (not shown) in the cassette loading section 58 rotates the lid 88 of the cassette 56 to a predetermined angular position to open the opening 86.

Then the suction pads 90*a* and 90*b* suck a predetermined surface of the stimulable phosphor sheet 40 and move the stimulable phosphor sheet 40 toward the sheet conveyor system 50.

Substantially simultaneously with the time the leading end of the stimulable phosphor sheet 40 is nipped by the drive roller 1 and the nip roller 2 which have been rotated at a predetermined speed, the suction pads 90*a* and 90*b* release the stimulable phosphor sheet 40. Then the stimulable phosphor sheet 40 is continuously transferred to the roller pairs 7 from the roller pair 3 and conveyed to the read-out section 66 passing by the erasing section 64.

In the read-out section 66, while the stimulable phosphor sheet 40 is being conveyed in the direction of arrow A by the sub-scanning system 78, the laser beam L is caused to scan the stimulable phosphor sheet 40 in the main scanning direction by the optical system 80 and the radiation image stored on the stimulable phosphor sheet 40 is photoelectrically read by the light condensing system 82.

After reading of the radiation image in the read-out section 66, the stimulable phosphor sheet 40 is conveyed in the reverse direction, and the residual energy of the radiation is fully released from the stimulable phosphor sheet 40 by exposing the stimulable phosphor sheet to light emitted from the erasing light sources 70 when vertically passing through the erasing section 64. Then the stimulable phosphor sheet 40 is returned to the cassette 56 through the sheet separator 60. When the cassette 56 is taken out from the cassette loading section 58, the lid 88 is automatically closed in a light-tight fashion.

Figure 6:
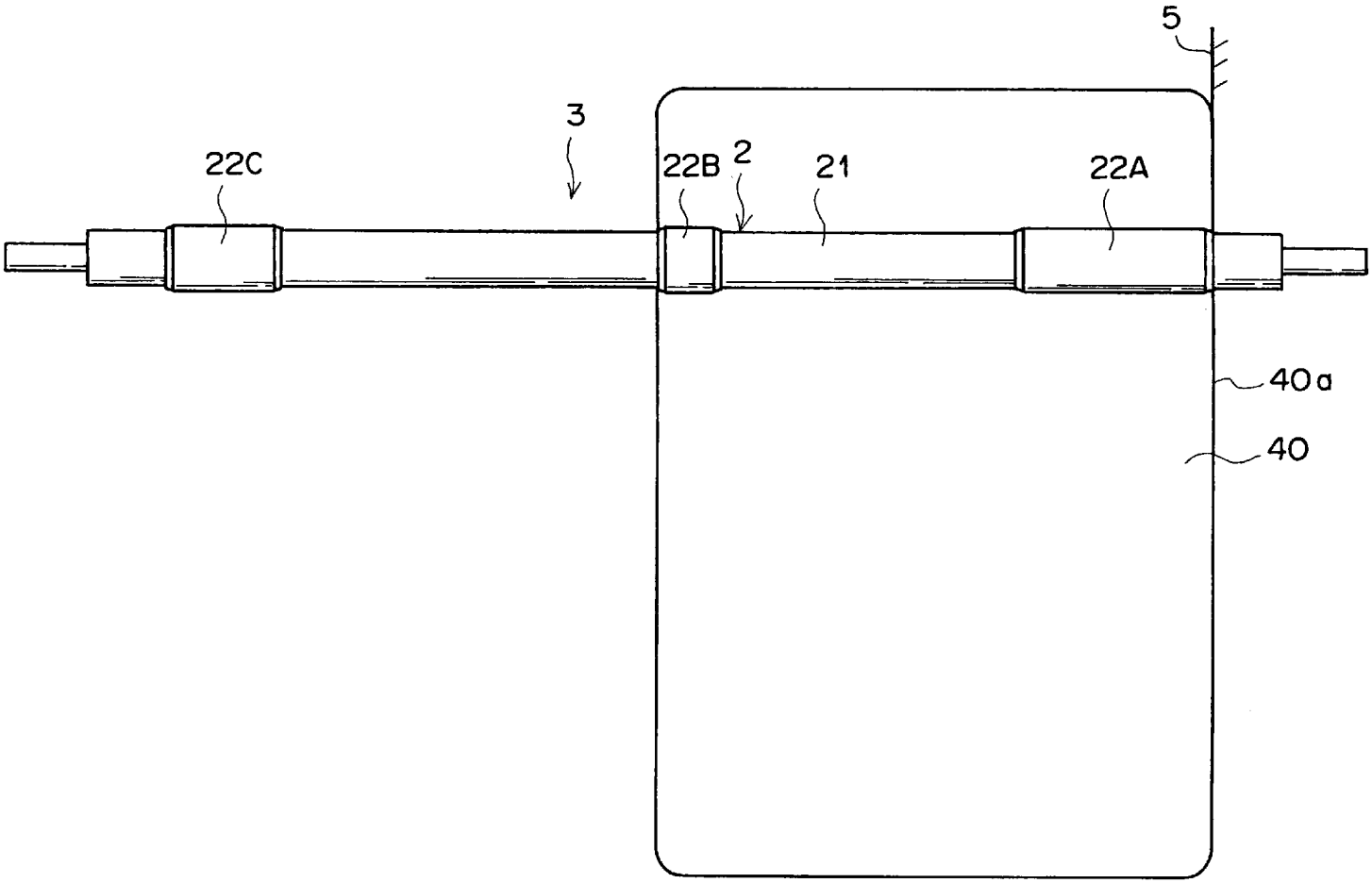
FIG. 6 is a view for illustrating conveyance of the small size stimulable phosphor sheet.

When a radiation image is read out from a small size stimulable phosphor sheet 40, the stimulable phosphor sheet 40 is conveyed with its side edge 40*a* kept along the reference position 5 as shown in FIG. 6. At this time, the stimulable phosphor sheet 40 is nipped by the roller portions 12A and 12B of the drive roller 1 and the roller portions 22A and 22B of the nip roller 2. Since the core shaft 23 of the nip roller 2 is thicker between the roller sections 22A and 22B than between the roller portions 22B and 22C, the urging forces acting on the stimulable phosphor sheet 40 through the roller sections 22A and 22B are substantially equal to each other even if the force of the compression spring 27*b* near to the end 23*b* is stronger than the compression spring 27*a* near to the end 23*a*. Accordingly, the conveying speed becomes substantially equal at opposite edges of the stimulable phosphor sheet 40 and the stimulable phosphor sheet 40 can be conveyed substantially straight.

Figure 7:
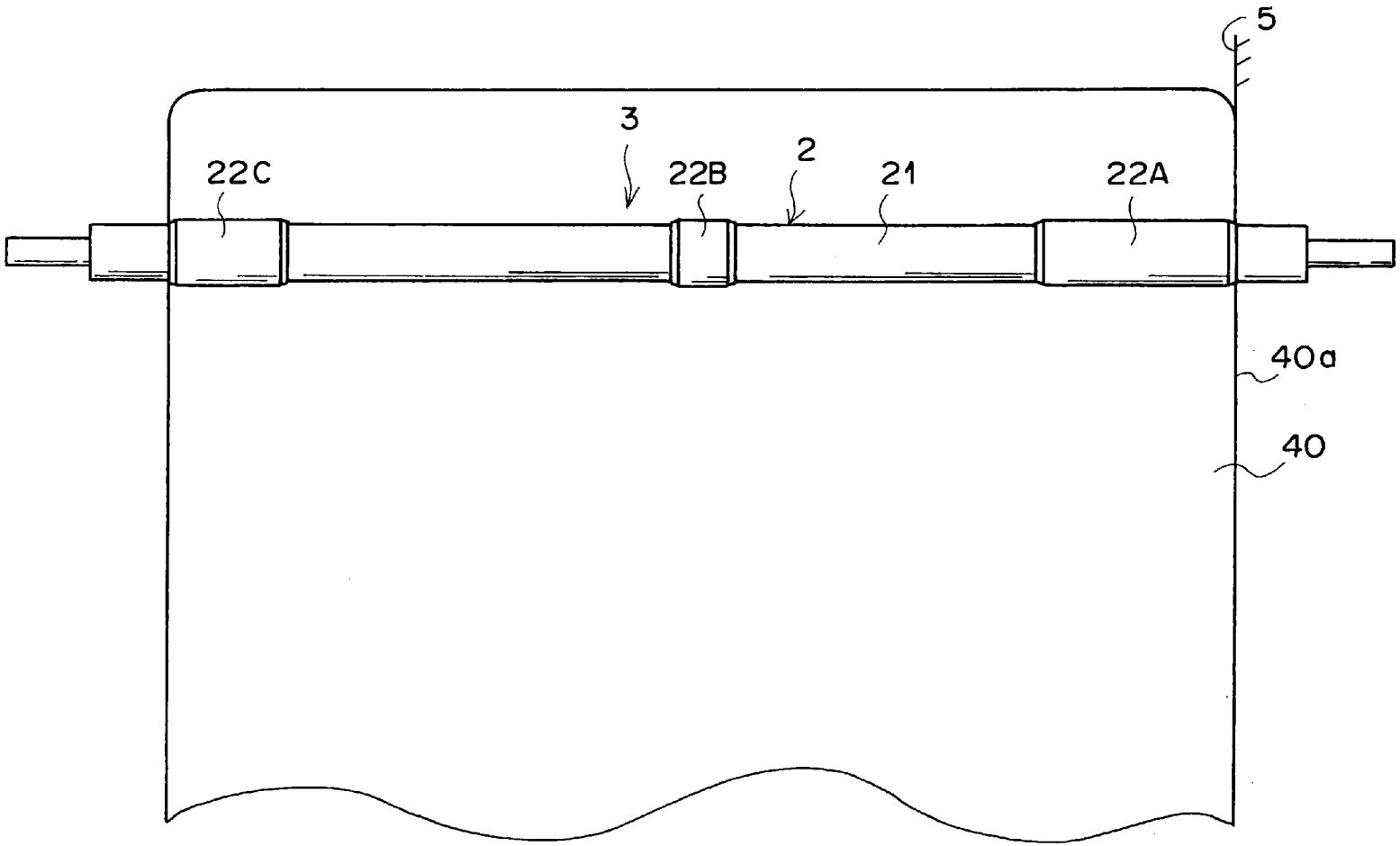
FIG. 7 is a view for illustrating conveyance of the large size stimulable phosphor sheet.

When a large size stimulable phosphor sheet 40 is conveyed, the stimulable phosphor sheet 40 is conveyed with its side edge 40*a* kept along the reference position 5 as shown in FIG. 7. At this time, the stimulable phosphor sheet 40 is nipped by all the roller portions 12A, 12B and 12C of the drive roller 1 and all the roller portions 22A, 22B and 22C of the nip roller 2. Since the core shaft 23 of the nip roller 2 is thicker between the roller sections 22A and 22B than between the roller portions 22B and 22C, the pressing force acting on the stimulable phosphor sheet 40 due to the gravity of the nip roller 2 is stronger on the reference position side than on the other side. However since the force of the compression spring 27*b* near to the end 23*b* is stronger than the compression spring 27*a* near to the end 23*a*, the total urging force acting on the stimulable phosphor sheet 40 during conveyance becomes substantially equal to each other at opposite edges of the stimulable phosphor sheet 40. Accordingly, the conveying speed becomes substantially equal at opposite edges of the stimulable phosphor sheet 40 and the stimulable phosphor sheet 40 can be conveyed substantially straight.

Further since the outer diameter of the core shaft 23 is larger on the side near to the end portion 23*a* than on the side near to the end portion 23*b*, the shaft 21 and the roller portions 22A, 22B and 22C may the same as the shaft 11 and the roller portions 12A, 12B and 12C of the drive roller 1. The shafts 11 and 21 are of resin and may be formed by the use of the same mold, which reduces the production cost.

Further, since the roller portions 12A, 12B, 12C, 22A, 22B and 22C are relatively small in thickness, i.e., 1.5 to 2 mm, collapse of the center roller sections 12B and 22B can be relatively small even if the nip roller 2 is inclined to nullify the space between the roller portion 12C and 22C, whereby inclination of the stimulable phosphor sheet 40 can be suppressed.

Figure 8:
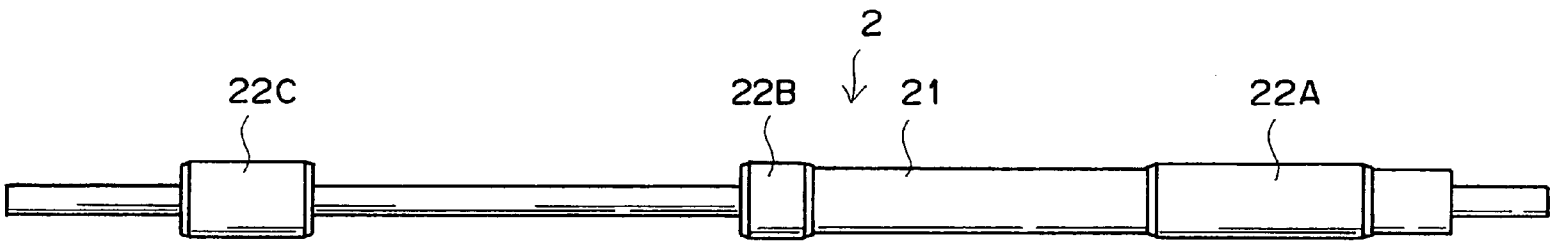
FIG. 8 is a view showing the nip roller employed in another embodiment of the present invention.
Figure 9:
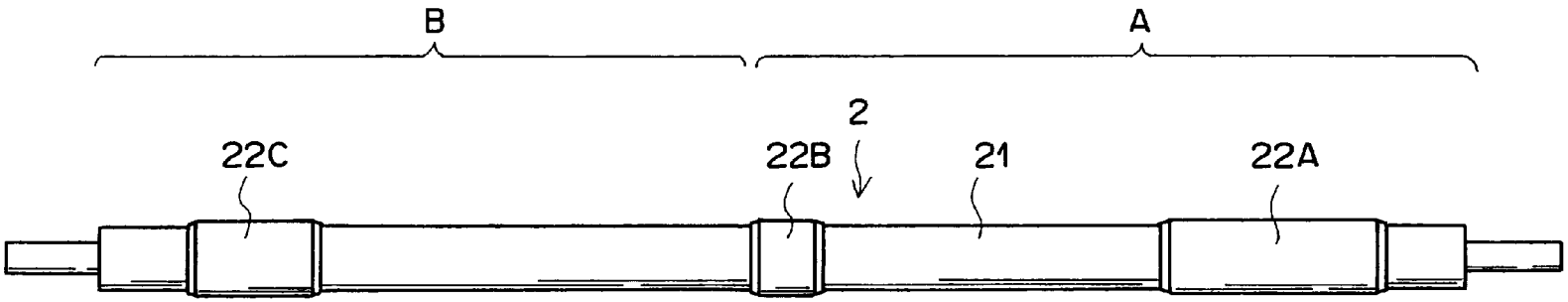
FIG. 9 is a view showing the nip roller employed in still another embodiment of the present invention.
Figure 10:
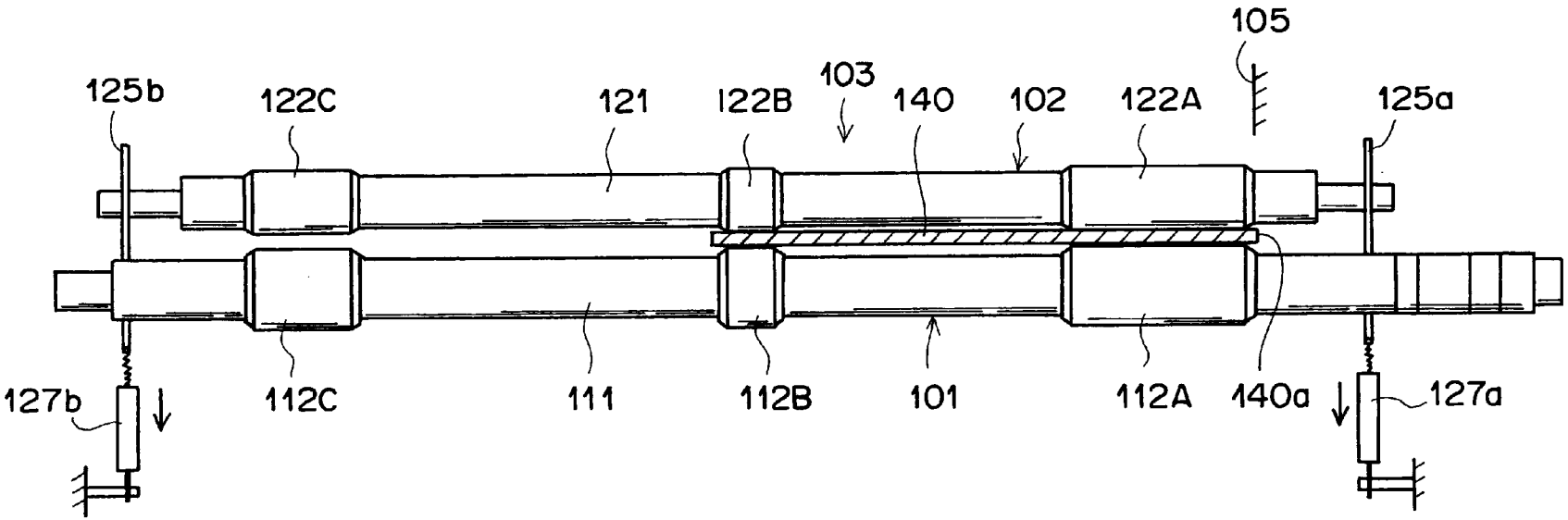
FIG. 10 is a view for illustrating a conventional sheet conveyor system.
Figure 11:
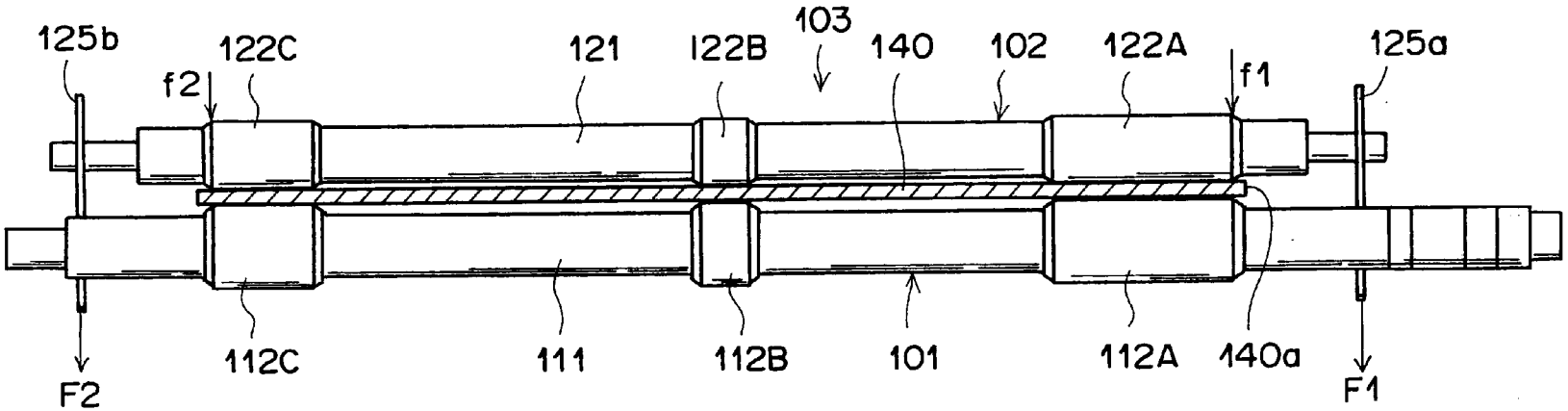
FIG. 11 is a view for illustrating setting of the force of the springs when a large size sheet is to be conveyed in the conventional sheet conveyor system.
Figure 12:
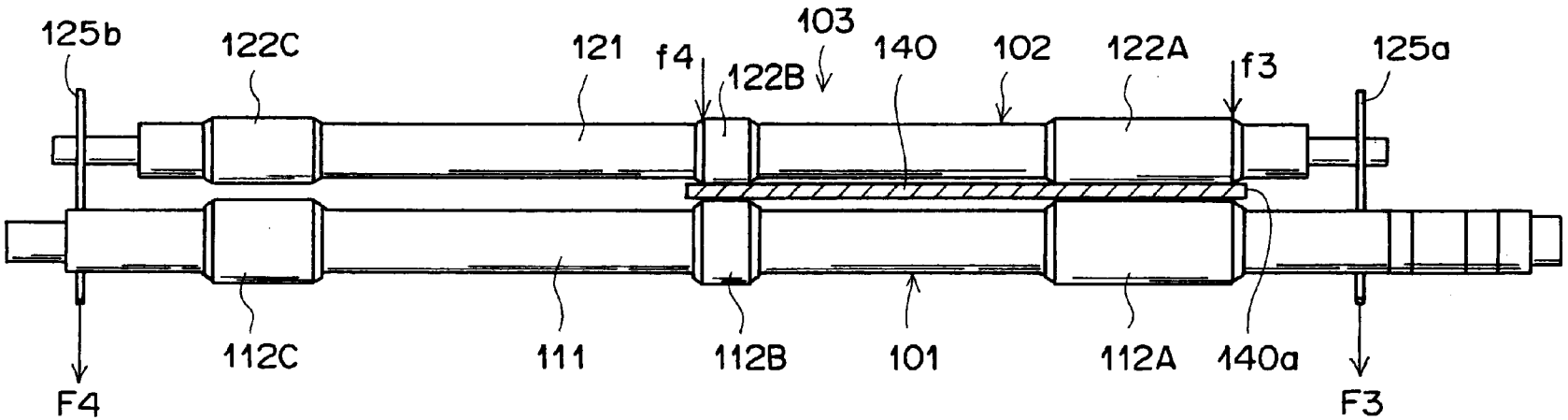
FIG. 12 is a view for illustrating setting of the force of the springs when a small size sheet is to be conveyed in the conventional sheet conveyor system.

Though, in the embodiment described above, the shaft 21 of the nip roller 2 is hollow and comprises a core shaft 23 which is larger in the outer diameter on the side near to the end portion 23*a* than on the side near to the end portion 23*b*, the shaft 21 may be solid and may be formed so that its outer diameter is larger on the side near to the end portion 23*a* than on the side near to the end portion 23*b* as shown in FIG. 8. Further, the portion A of the shaft 21 on the reference position side may be formed of relatively heavy material such as stainless steel while the portion B opposite to the reference position 5 is formed of relatively light material such as resin as shown in FIG. 9.

Though, in the embodiment described above, the present invention is applied to a sheet conveyor system for conveying stimulable phosphor sheets, the present invention may be applied to various sheet conveyor systems for conveying various sheet-like materials such as a photographic film.

What is claimed is:

1. A sheet conveyor system which conveys a plurality of kinds of sheet material, different at least in dimension in a first direction, in a second direction normal to the first direction with an edge of each sheet material extending in the second direction held along a reference position, the sheet conveyor system comprising:

a roller pair which includes a drive roller and a nip roller and conveys the sheet material in the second direction by driving the drive roller with the nip roller urged toward the drive roller under its gravity and a predetermined urging force to press the sheet material against the drive roller, wherein the improvement comprises that the nip roller is larger in weight of a part on the side of the reference position than that of a part on the side opposite to the reference position and is substantially uniform in weight over a predetermined length between the end on the side of the reference position and a part at a predetermined distance from the end on the side of the reference position, and said predetermined urging force is set stronger on the side opposite to the reference position than on the side of the reference position.

2. A sheet conveyor system as defined in claim 1 in which each of the drive roller and the nip roller comprises a shaft extending in the first direction and a plurality of roller portions provided on the shaft at predetermined intervals in the longitudinal direction thereof, with the part between the roller portion nearest to the reference position and the roller portion adjacent to the roller portion nearest to the reference position being uniform in weight.

3. A sheet conveyor system as defined in claim 2 in which the shaft of the nip roller is larger in outer diameter at the reference position side portion than that at the portion remote from the reference position.

4. A sheet conveyor system as defined in claim 2 in which the shaft of the nip roller comprises a hollow pipe-shaped member and a core shaft which supports the pipe-shaped member for rotation with the core shaft being larger in outer diameter at the reference position side portion than that at the portion remote from the reference position.

5. A sheet conveyor system as defined in claim 2 in which the reference position side portion of the nip roller is formed of a material which is heavier than that forming the portion remote from the reference position.

* * * * *